US009558617B2

(12) United States Patent
Peera

(10) Patent No.: US 9,558,617 B2
(45) Date of Patent: Jan. 31, 2017

(54) ELECTRONIC POKER SYSTEM

(71) Applicant: James F. Peera, Las Vegas, NV (US)

(72) Inventor: James F. Peera, Las Vegas, NV (US)

( * ) Notice: Subject to any disclaimer, the term of this patent is extended or adjusted under 35 U.S.C. 154(b) by 0 days.

(21) Appl. No.: 15/052,967

(22) Filed: Feb. 25, 2016

(65) Prior Publication Data

US 2016/0247347 A1 Aug. 25, 2016

Related U.S. Application Data

(60) Provisional application No. 62/120,499, filed on Feb. 25, 2015.

(51) Int. Cl.

| | |
|---|---|
| ***G07F 17/32*** | (2006.01) |
| ***A63F 1/06*** | (2006.01) |
| ***A63F 1/10*** | (2006.01) |

(52) U.S. Cl.

CPC ..... *G07F 17/322* (2013.01); *A63F 1/062* (2013.01); *A63F 1/10* (2013.01); *G07F 17/3293* (2013.01)

(58) Field of Classification Search

None

See application file for complete search history.

(56) References Cited

U.S. PATENT DOCUMENTS 2,001,918 A * 5/1935 Nevius ..... A63F 1/06 273/151
2006/0058084 A1* 3/2006 Crawford, III ..... G07F 17/32 463/11
2008/0076505 A1* 3/2008 Nguyen ..... G07F 17/32 463/16
2008/0113767 A1* 5/2008 Nguyen ..... G07F 17/32 463/25
2009/0029756 A1* 1/2009 Guest ..... A63F 1/02 463/13
2009/0191933 A1* 7/2009 French ..... G07F 17/32 463/12
2010/0311489 A1* 12/2010 Miller ..... A63F 1/12 463/16
2011/0045886 A1* 2/2011 Hayes ..... G07F 17/32 463/11
2011/0079959 A1* 4/2011 Hartley ..... G07F 17/32 273/292

* cited by examiner

*Primary Examiner* — Milap Shah
*Assistant Examiner* — Robert T Clarke, Jr.

(57) ABSTRACT

An electronic poker system is a system for reducing slowdowns and errors during play while delivering an authentic poker experience for players. The system includes a table where players are able to sit at a plurality of player stations while a live dealer sits at a dealer station. Each player's cards are shown on at least one flexible display while community cards and other game information is shown on at least one game display that is visible to all players. Each of the at least one flexible display is secured to a playing surface of the table through a tether device. A gameplay control unit automates many functions such as dealing player cards, dealing community cards, fixing dealer mistakes, and folding player hands. The live dealer is able to initiate these functions through at least one dealer input device.

19 Claims, 14 Drawing Sheets

ELECTRONIC POKER SYSTEM

The current application claims a priority to the U.S. Provisional Patent application Ser. No. 62/120,499 filed on Feb. 25, 2015.

FIELD OF THE INVENTION

The present invention relates generally to a system for playing various types of poker. More specifically, the present invention is an electronic poker system that reduces slowdowns and errors during play while delivering an authentic poker experience for players.

BACKGROUND OF THE INVENTION

Poker is a widely played family of card games in which players attempt to assemble the strongest hand using cards in a dealt hand as well as shared "community cards". A player is able to place wagers as well based on the perceived value of his or her hand relative to the hands of other players. Poker is most commonly played with players seated perimetrically around a table. In more formal settings, a dealer is present to deal cards to players as well as to progress play. While the general concept of poker is rather straightforward, there are several issues that are inherent to conventional playing cards and live dealers. Because physical cards must be shuffled and dealt before a new hand can be played as well as additional cards during play, there is an ever-present risk of dealer errors such as dealing cards to the wrong player or dealing cards prematurely. As a result, the use of a live dealer and physical cards can result in fewer hands played as well as an overall slowdown in play, leading to loss of players' time and enjoyment. This further results in reduced revenue for casinos and other establishments that charge a rake (commission fee) per hand played. Another drawback of physical playing cards is the ability to mark or flash the cards for dishonest play.

Electronic card tables attempt to address the issues inherent to physical playing cards by fully automating the traditionally human aspects of poker. Electronic card tables typically feature a computer-controlled electronic dealer as well as electronic chips and electronic cards in lieu of a live dealer, physical chips, and physical cards. Players are able to view their cards via individual digital displays and are able to electronically perform actions such as wagering, folding, and checking during play. Community cards, player wagers, and other game information are typically displayed on a large central display that is visible to all players. Electronic card tables are generally able to increase the rate of play as well as greatly reduce the likelihood of error. However, electronic card tables are not held in high regard due to the perceived failure of the tables to deliver an authentic poker experience. The lack of a live dealer, lack of physical cards, lack of physical chips, and use of large digital displays are reminiscent of online or video poker games.

The present invention is an electronic poker system that combines advantages provided by both conventional card tables and electronic card tables in order to deliver an authentic poker experience for players while mitigating dealer mistakes. A live dealer is present during use of the present inventions and players are able to place wagers utilizing physical chips. The dealer is additionally responsible for monitoring player wagers as well as awarding and/or dividing the pot(s) following the conclusion of a hand. However, the present invention features flexible electronic displays in lieu of physical cards. The flexibility of the electronic displays and tethering devices connecting the electronic displays to the table enable players to physically handle the electronic displays in a similar manner to physical cards. Community cards are shown on a central display that is visible to all players. The dealer uses one or more input devices to deal electronic cards to the players' flexible displays and central display at a faster rate than dealing conventional poker cards. In addition, the dealer utilizes an action undo input device to quickly reverse dealing mistakes.

DETAIL DESCRIPTIONS OF THE INVENTION

All illustrations of the drawings are for the purpose of describing selected versions of the present invention and are not intended to limit the scope of the present invention.

Figure 1:
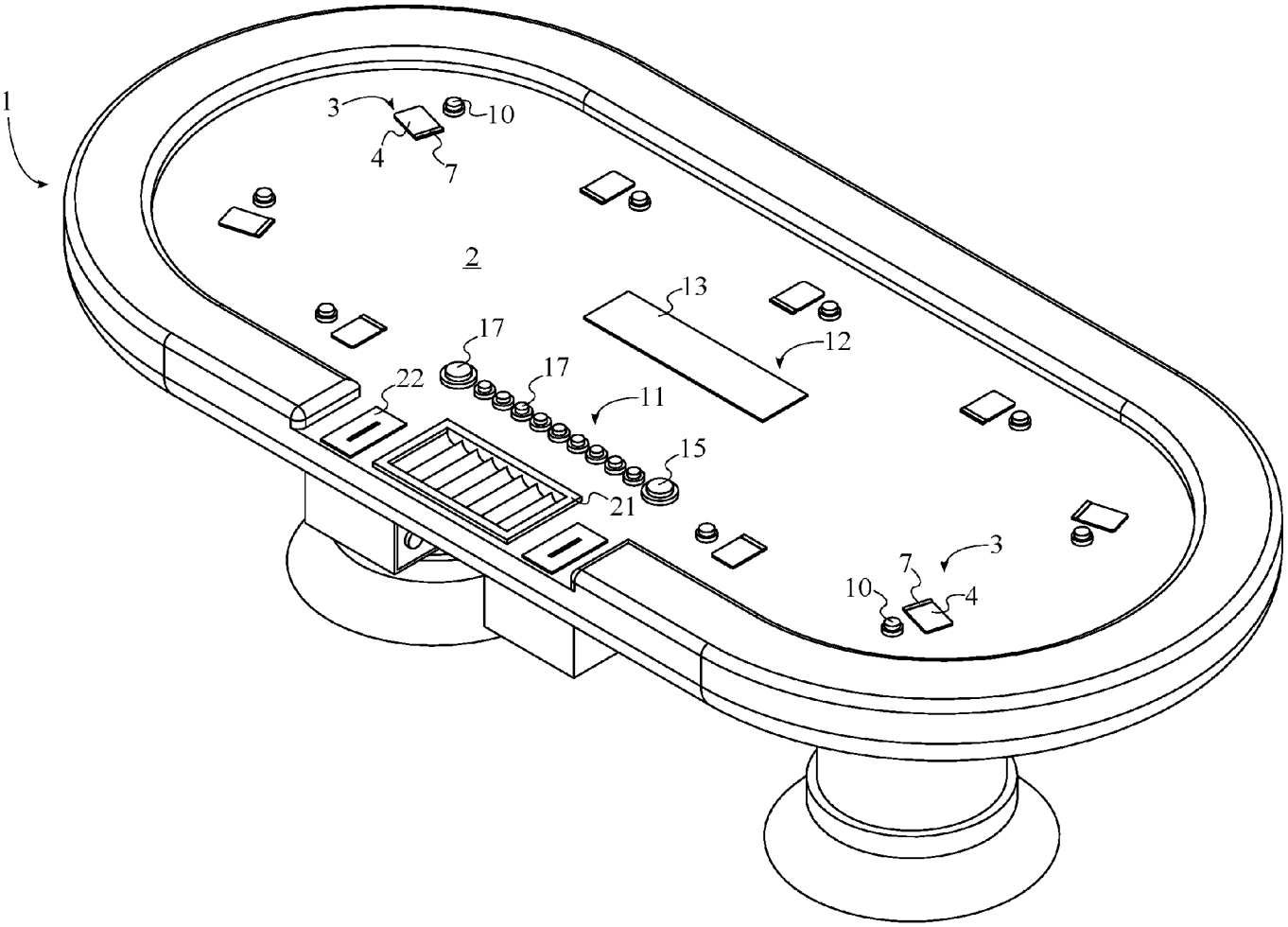
FIG. 1 is a perspective view of the present invention.
Figure 2:
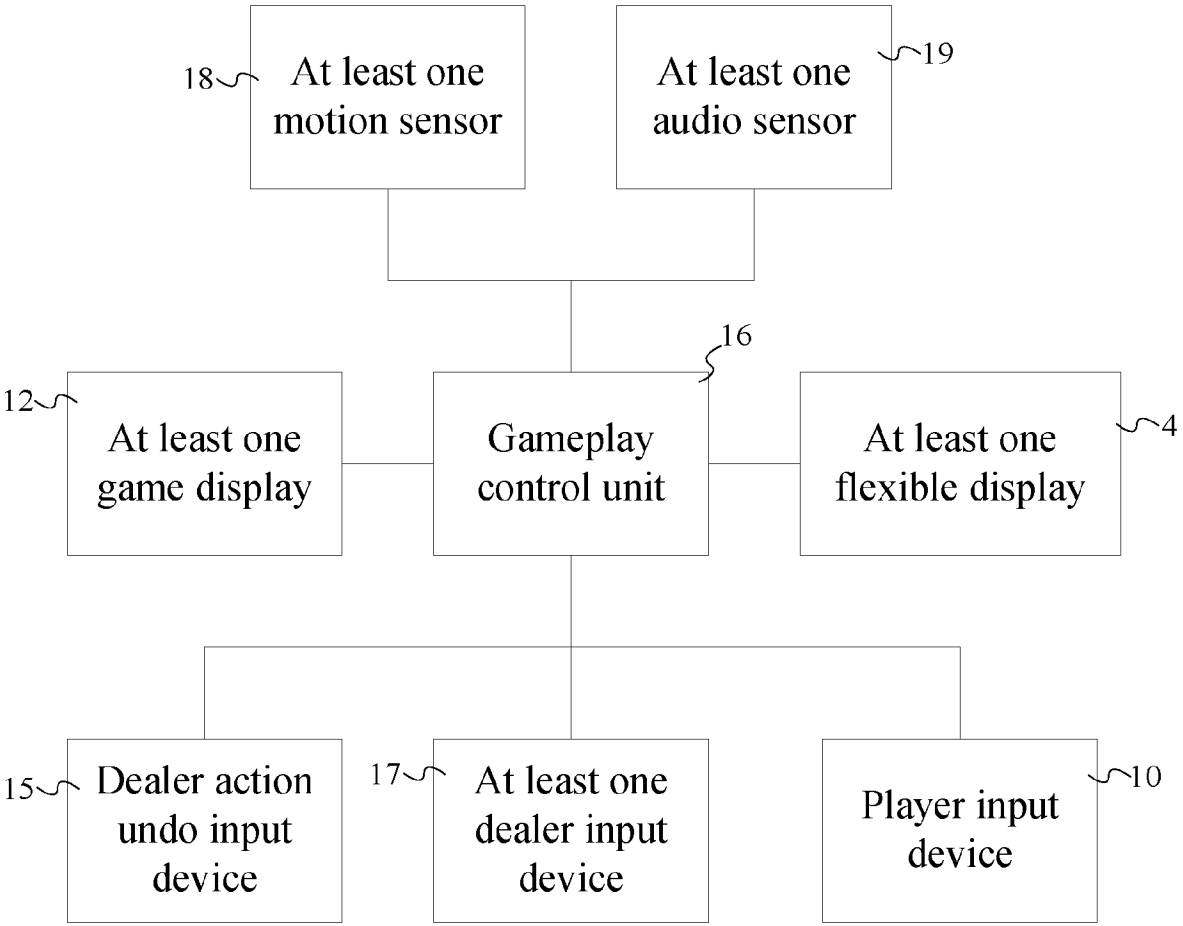
FIG. 2 is a diagram of the electronic connections of the present invention.

The present invention is an electronic poker system for improving the rate of play and reducing errors during a poker game while providing an authentic poker experience. The present invention is shown in FIG. 1 and FIG. 2 and comprises a table 1, a plurality of player stations 3, a dealer station 11, at least one game display 12, a dealer action undo input device 15, and a gameplay control unit 16. The present invention is designed for use with physical chips that players utilize to place wagers. Additionally, a live dealer is present during use of the present invention in order to provide an authentic poker experience to players. Electronic components of the present invention are connected to and provided electrical power from an external power source.

The table 1 provides a structure at which players are able to sit during the course of a game. The table 1 comprises a playing surface 2 on which the players are able to play the game and on which players are provided game information. In the preferred embodiment of the present invention, the table 1 is a conventional poker table that features one or more supporting legs and that is sufficiently sized such that players are able to be comfortably seated around the table 1. The plurality of player stations 3 is distributed about the table 1 to ensure that players are comfortably spaced apart. The players are seated at the plurality of player stations 3 and the plurality of player stations 3 is preferably perimetrically distributed about the table 1 such that players are able to face the table 1 when seated at the plurality of player stations 3. The dealer station 11 serves as a seating space for a live dealer who is able to direct the flow of a poker game. The dealer station 11 is positioned on the table 1, among the plurality of player stations 3, positioning the live dealer among the players as in a conventional poker table. The table 1 may further include a padded rail extending around the perimeter of the table 1 with an indent in the padded rail for the dealer station 11.

Figure 6:
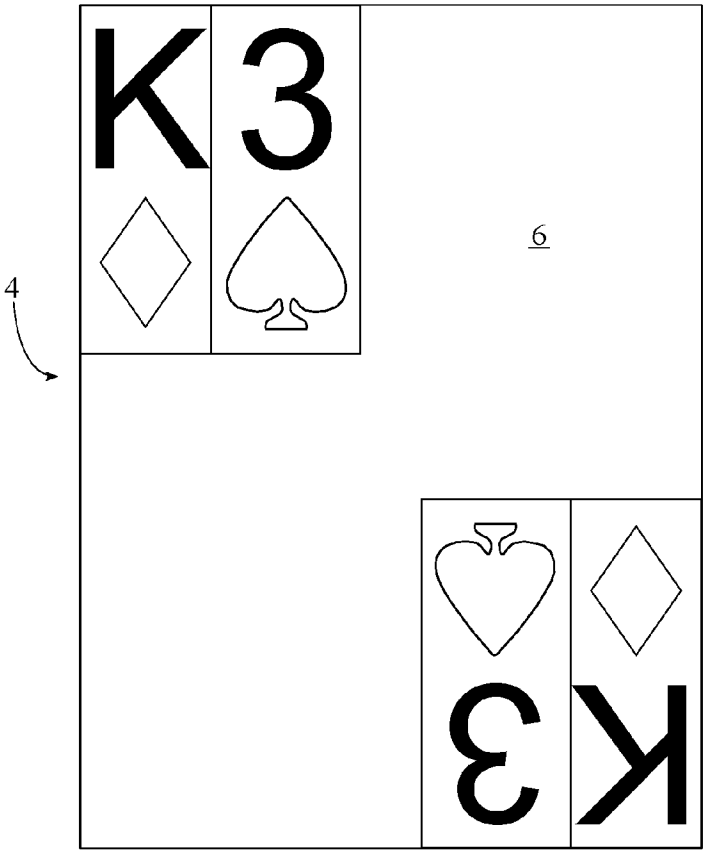
FIG. 6 is a top view of the at least one flexible display showing the front surface.

Each of the plurality of player stations 3 comprises at least one flexible display 4. In the preferred embodiment of the present invention, the at least one flexible display 4 is a flexible organic light-emitting diode (FOLED) display that provides each player with a digital representation of the cards in the player's hand during the course of a poker game. The at least one flexible display 4 serves as a physical substitute for conventional playing cards and is approximate in size to a conventional playing card. Because the at least one flexible display 4 is flexible, the at least one flexible display 4 may be physically handled and manipulated similar to physical playing cards. More specifically, the player may easily perform actions such as discreetly viewing his or her hand by bending the at least one flexible display 4 upward while the at least one flexible display 4 lies flat on the playing surface 2. The at least one flexible display 4 may be a single display on which multiple cards are displayed as shown in FIG. 6. Alternatively, the at least one flexible display 4 may be multiple displays, each of which is representative of a single card. Each of the at least one flexible display 4 is mounted to the playing surface 2, similar to the manner in which conventional playing cards are placed on a table.

Figure 13:
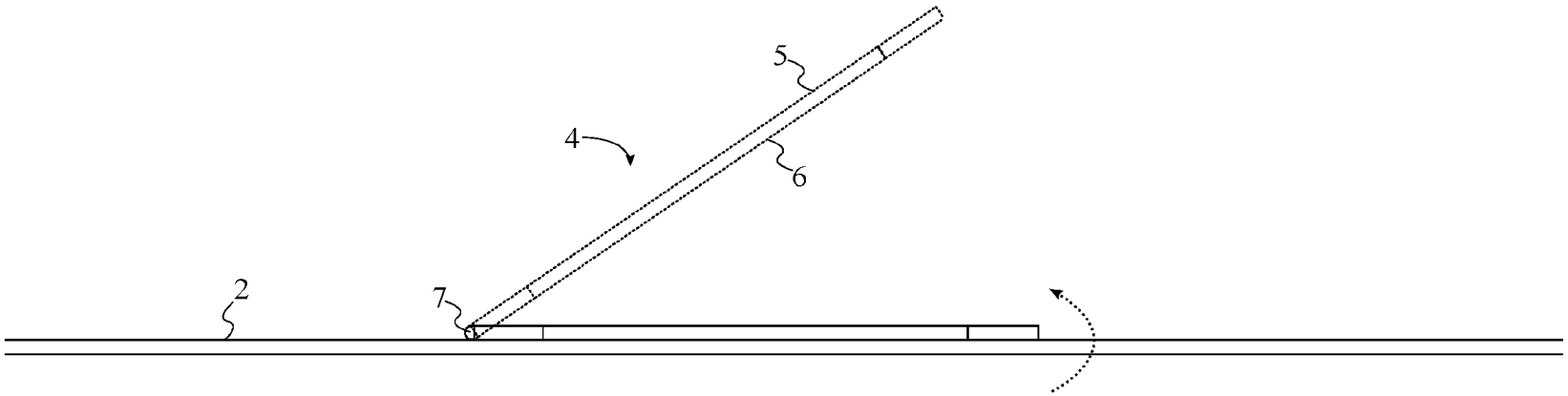
FIG. 13 is a diagrammatic view displaying how the hinge tether device is utilized.
Figure 14:
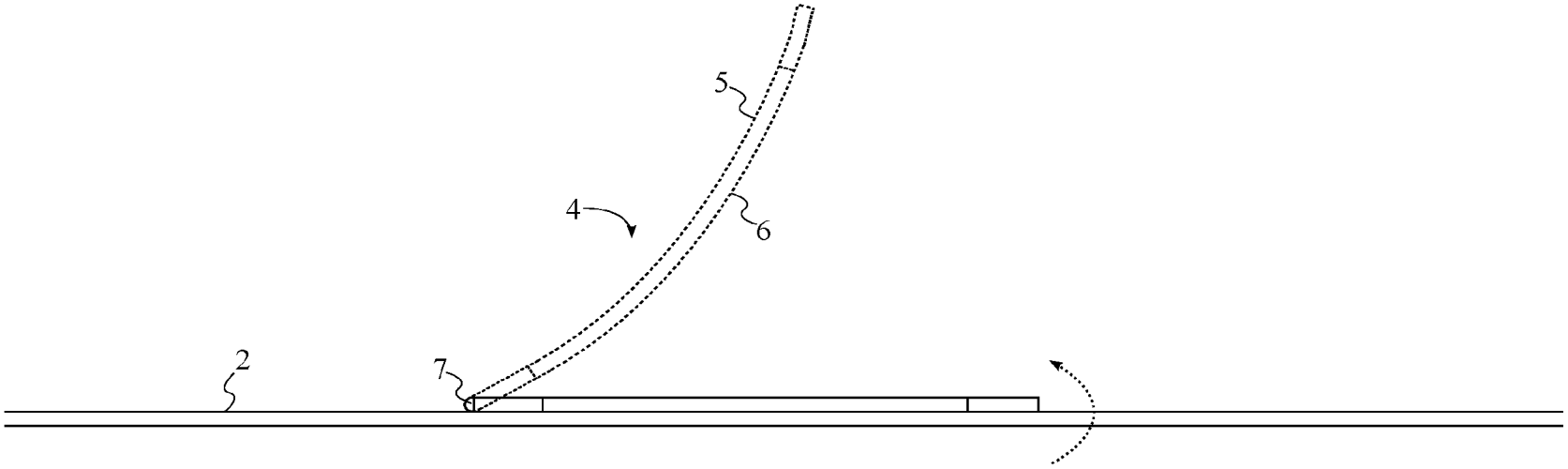
FIG. 14 is an additional diagrammatic view displaying how the hinge tether device is utilized.

Each of the at least one flexible display 4 may further comprise a tether device 7. As such, each of the at least one flexible display 4 may be removably or non-removably mounted to the playing surface 2 through the tether device 7 as shown in FIG. 1. This enables the at least one flexible display 4 to be separated from the playing surface 2 as needed. The tether device 7 may be a hinge, cable, or similar device that allows the user to view the cards displayed on the at least one flexible display 4. The tether device 7 additionally facilitates actions such as revealing a player's hand at the conclusion of a hand. For example, a hinge allows a player to flip over the at least one flexible display 4 while the at least one flexible display 4 is still attached to the playing surface 2 as shown in FIG. 13 and FIG. 14. The tether device 7 is shown as a hinge in FIG. 1 while the tether device 7 is shown as a cable in FIG. 3. Electrical power may be provided to the at least one flexible display 4 through the tether device 7. Alternatively, the at least one flexible display 4 may include an integrated power source, allowing the at least one flexible display 4 to function independently.

When the at least one flexible display 4 is functioning independently, the at least one flexible display 4 may communicate with the gameplay control unit 16 via a wireless protocol such as, but not limited to, Bluetooth and Wi-Fi.

Figure 7:
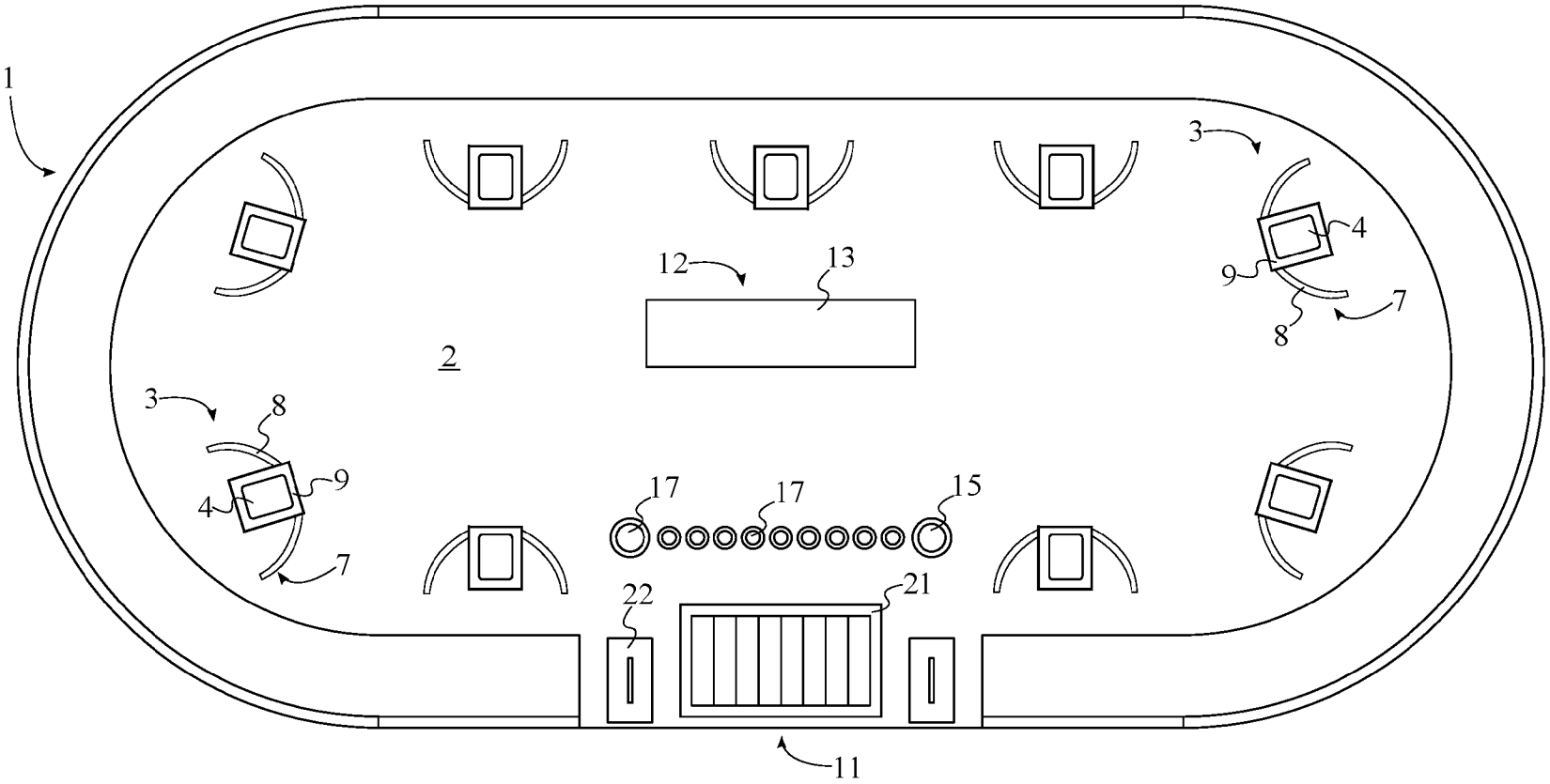
FIG. 7 is a top view of an embodiment of the present invention, wherein the tether device comprises a track and a platform.

In the embodiment of the present invention shown in FIG. 7, the tether device 7 comprises a track 8 and a platform 9. The platform 9 serves to secure the at least one flexible display 4 to the playing surface 2 and as such, the at least one flexible display 4 is positioned on the platform 9. The track 8 is positioned on the playing surface 2 while the platform 9 is removably and slidably engaged into the track 8. This allows the platform 9 and, by extension, the at least one flexible display 4 to be moved along the track 8. The track 8 and the platform 9 provide the user with a means of adjusting the position of the at least one flexible display 4 while allocating space for chips. In alternative embodiments of the present invention, the platform 9 may be non-removable from the track 8.

Figure 5:
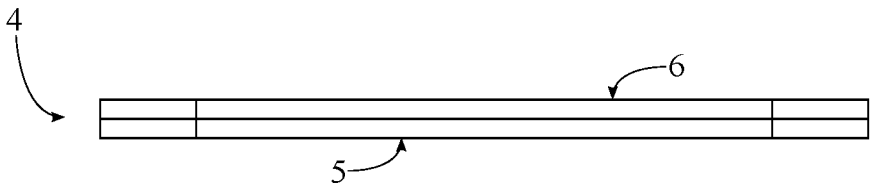
FIG. 5 is a side view of the at least one flexible display showing the backing surface and the card surface.
Figure 10:
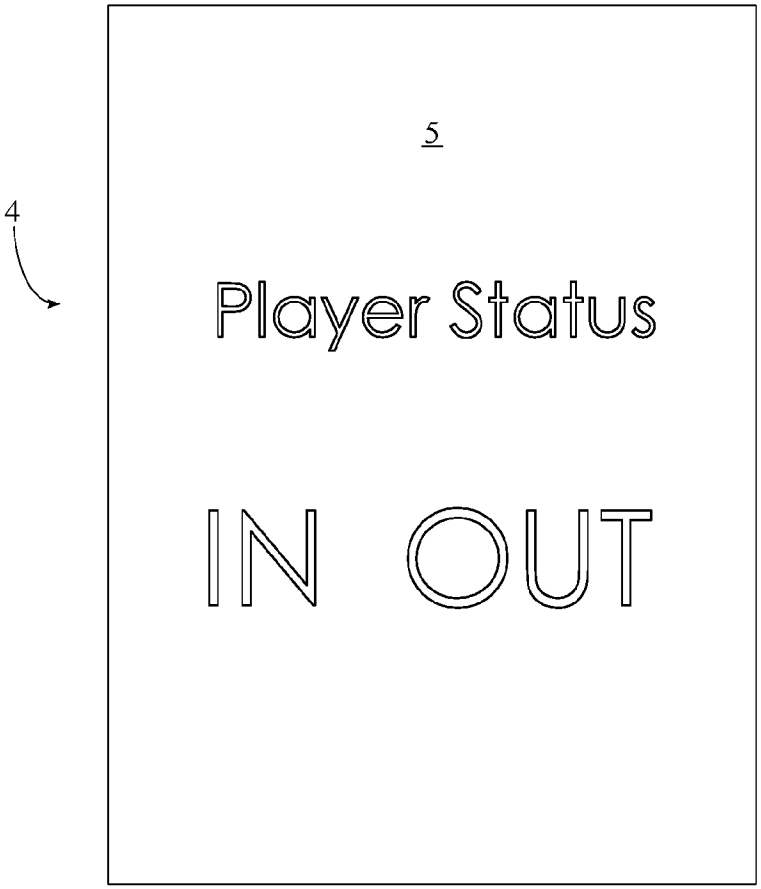
FIG. 10 is a bottom view of the at least one flexible display showing the backing surface with the backing surface displaying a player status indicator.
Figure 11:
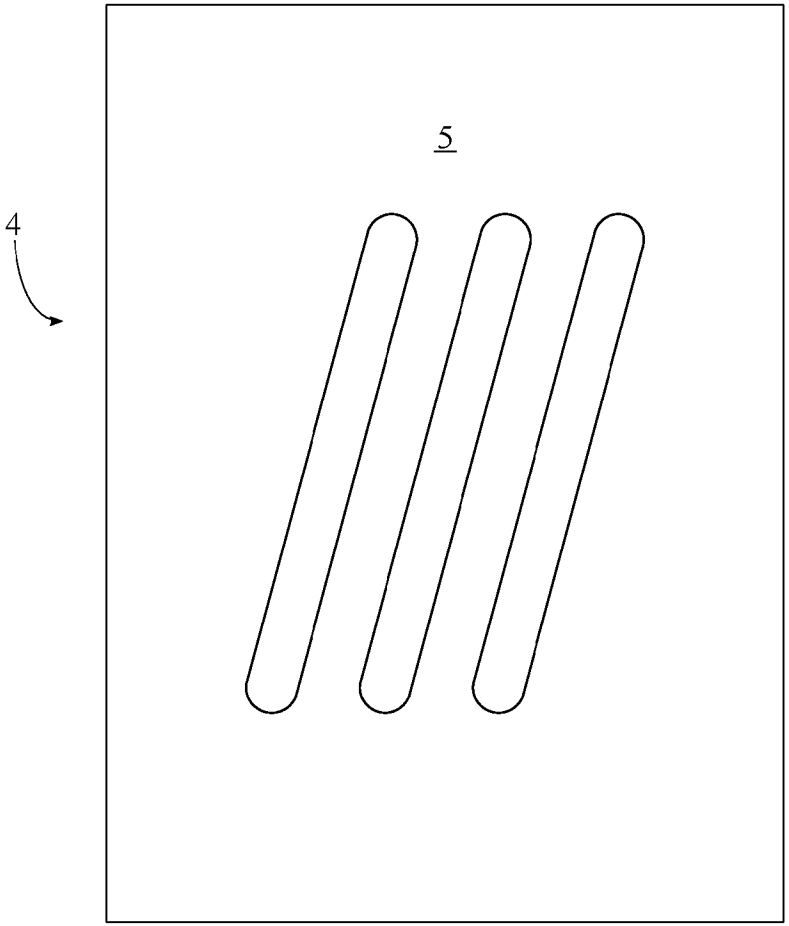
FIG. 11 is a bottom view of the at least one flexible display showing the backing surface with the backing surface displaying an electronic image of a logo.
Figure 12:
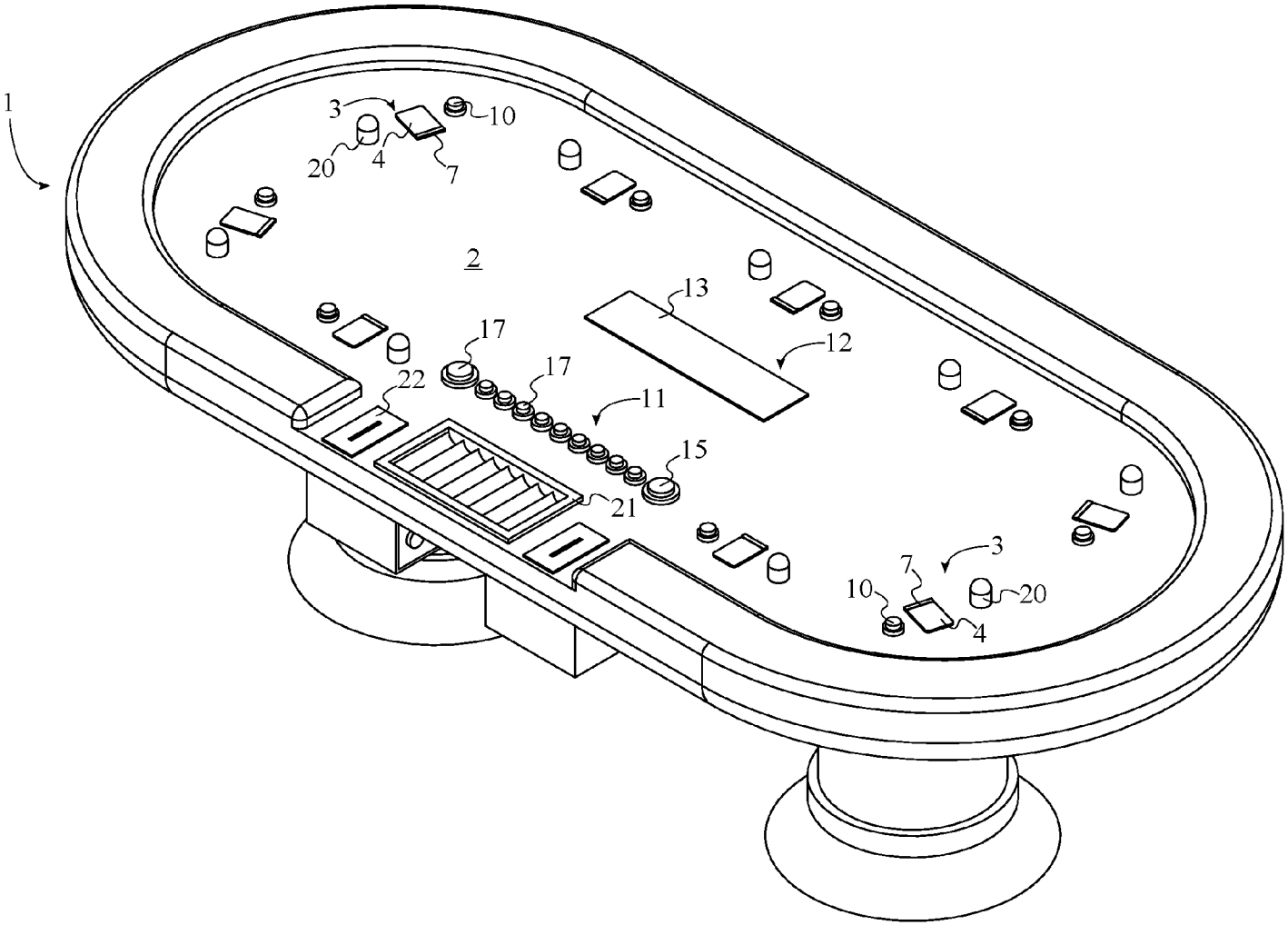
FIG. 12 is a perspective view of the present invention featuring the plurality of player status indicator devices.

With reference to FIG. 5 and FIG. 6, in the preferred embodiment of the present invention, each of the at least one flexible display 4 is composed of a flexible substrate and comprises a backing surface 5 and a front surface 6. The backing surface 5 and the front surface 6 are preferably FOLED touch displays. The materials of the at least one flexible display 4 are scratch, impact, and glare-resistant as well in order to prevent damage caused by physical chips and extensive use by players. The backing surface 5 and the front surface 6 are capable of displaying an independent image. The backing surface 5 may display an electronic image of a playing card backing as shown in FIG. 10. As such, when active, the backing surface 5 may become opaque in order to shield the front surface 6 from view. The backing surface 5 may become transparent as well. Additionally, the backing surface 5 may display a player status indicator as shown in FIG. 11 and be used for various purposes such as becoming illuminated to signify to the dealer that the player is active in a hand. As shown in FIG. 12, the backing surface 5 may display an electronic image of a logo as well. With continued reference to FIG. 5 and FIG. 6, the front surface 6 displays an electronic image of a playing card and is representative of a player's hand or cards. Similar to the backing surface 5, the front surface 6 may become transparent (i.e. if the player is not participating in a hand). The backing surface 5 is layered adjacent to the front surface 6 in order to allow the at least one flexible display 4 to be handled and utilized similar to a conventional playing card. In the preferred embodiment of the present invention, each of the at least one flexible display 4 includes full color capabilities as well and as such, the backing surface 5 may display virtually any ornamental design. The front surface 6 may display the player's card(s) in a number of ways. For example, the card(s) may be displayed from different viewpoints such as full card, half card, upright, and sideways. The font and font sizes for the digitally represented card(s) may be altered as well. The at least one flexible display 4 may be handled similar to a conventional playing card and thus contributes to providing an authentic poker experience. Additionally, the at least one flexible display 4 eliminates the possibility of card marking, card flashing, and other dishonest behavior during play.

Both the backing surface 5 and the front surface 6 may be utilized for user touch inputs. The player is able to perform various actions such as swiping on the backing surface 5 to fold a hand. The swiping of the backing surface 5 is similar to the motion of sliding conventional playing cards to the dealer when folding a hand. The touch functionality of the backing surface 5 and the front surface 6 may allow for various other actions through touch gestures.

Figure 3:
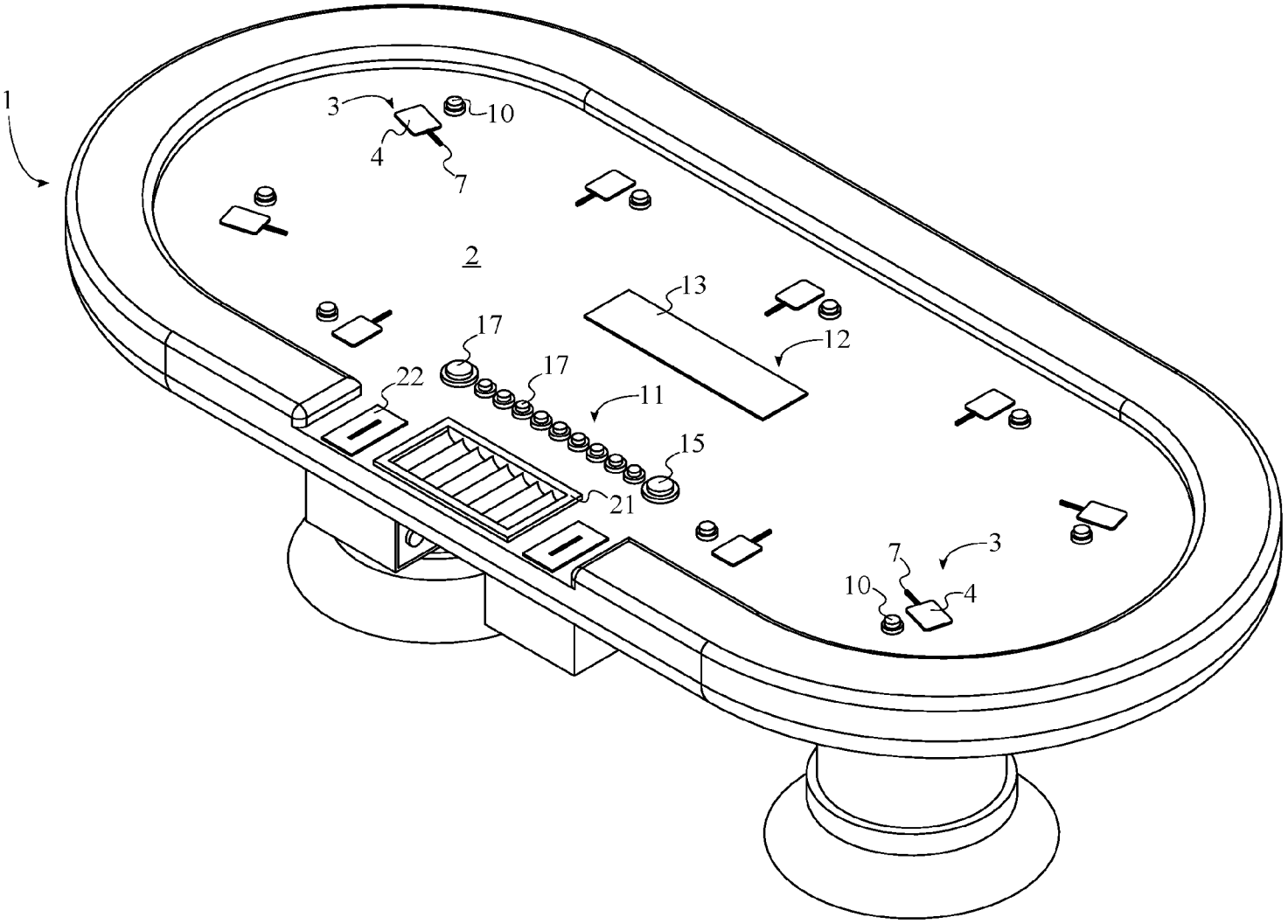
FIG. 3 is a perspective view of an embodiment of the present invention, wherein the tether device is a cable.
Figure 4:
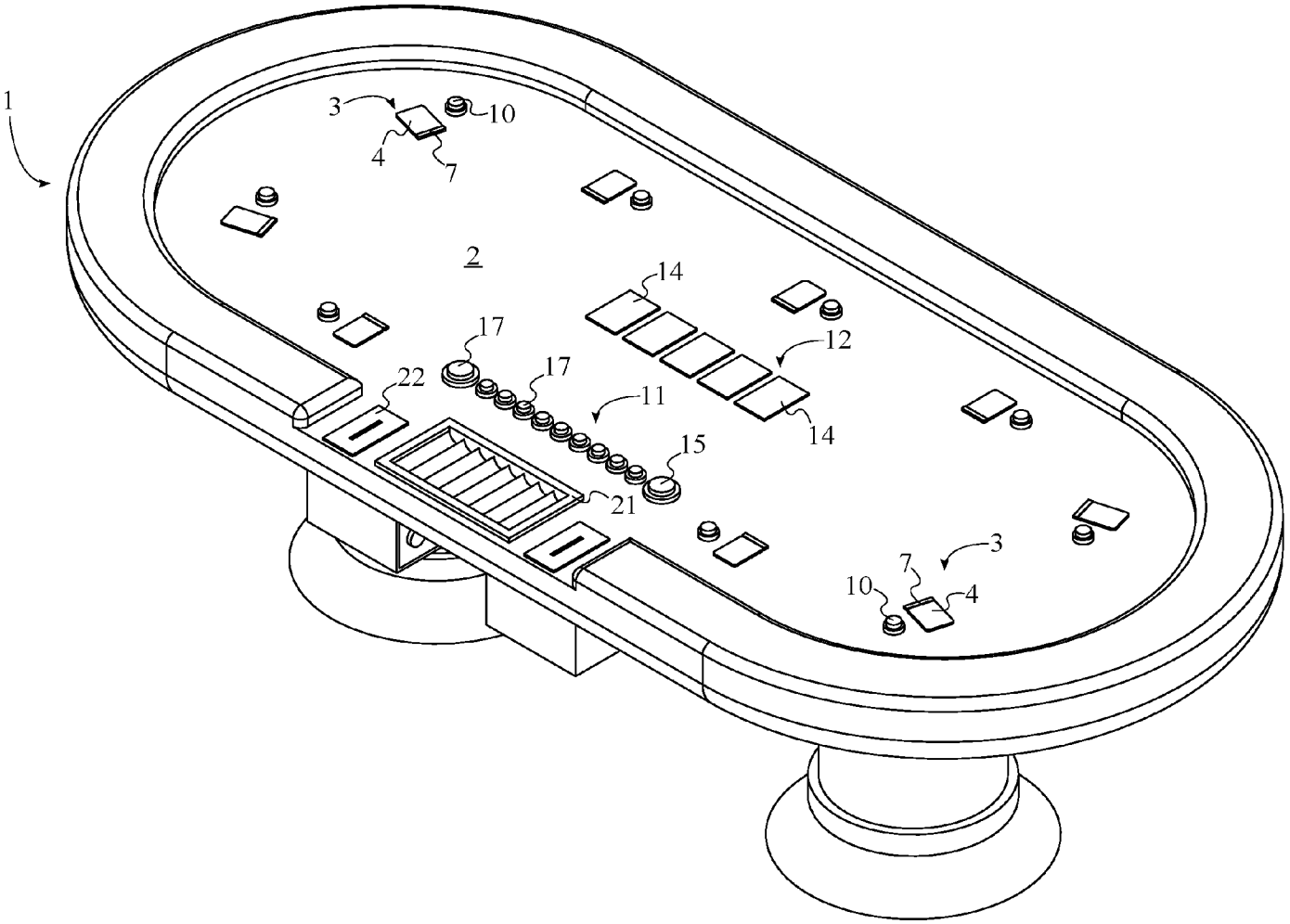
FIG. 4 is a perspective view of an embodiment of the present invention, wherein the at least one game display is a plurality of community card displays.

With reference to FIG. 1, FIG. 3, and FIG. 4, the at least one game display 12 is an electronic display on which game information is displayed and is positioned on the playing surface 2 in order to be visible to the players and the dealer. Within the context of a poker game, the at least one game display 12 displays a digital representation of community cards that are shared by all players. In the preferred embodiment of the present invention, player wagers and/or chip totals are not displayed on the at least one game display 12. In the embodiment of the present invention shown in FIG. 1 and FIG. 3 the at least one game display 12 comprises a community card display 13. In this embodiment, the community card display 13 is a single display on which all community cards are displayed and the at least one game display 12 is positioned on the playing surface 2. The community card display 13 is preferably positioned centrally on the playing surface and is thus positioned in a manner such that the community card display 13 is visible to all players as well as the dealer. In the embodiment of the present invention shown in FIG. 4, the at least one game display 12 comprises a plurality of community card displays 14. In this embodiment, the plurality of community card displays 14 is multiple card displays on which each community card is individually displayed. The plurality of community card displays 14 is preferably positioned centrally on the playing surface 2 in order to be visible to all players and the dealer. In this embodiment, the plurality of community card displays 14 is positioned adjacent to each other and is arranged in a single row, similar to the arrangement of the community cards in a conventional poker game such as Texas Hold'em. The at least one game display 12 is composed of the same or similar materials as those of the at least one flexible display 4 for scratch, impact, and glare-resistance. Additionally, the at least one game display 12 may become fully transparent, thereby allowing full view of the playing surface 2.

With reference to FIG. 2, the dealer action undo input device 15 enables the dealer to quickly undo any incorrect dealer actions such as dealing a card to a wrong player or dealing a community card prematurely. The dealer action undo input device 15 is positioned at the dealer station 11 for easy accessibility by the dealer. Actions inputted through the dealer action undo input device 15 are processed by the gameplay control unit 16. The gameplay control unit 16 is the electronic control system that automates the flow of the poker game. The gameplay control unit 16 is configured to operate and manage multiple types of community card poker games including, but not limited to, Texas Hold'em and Omaha. The gameplay control unit 16 is managed by the dealer and is able to perform actions such as dealing hands to the players and displaying the community cards. As such, the gameplay control unit 16 is electronically connected to the dealer action undo input device 15, the at least one game display 12, and each of the at least one flexible display 4. In the preferred embodiment of the present invention, the gameplay control unit 16 does not keep track of player wagers and/or total chips and is only responsible for card-related functions such as folding player hands, dealing specific cards to specific players, and dealing community cards. The live dealer is responsible for monitoring player wagers as well as awarding and/or dividing the pot(s) following a completed hand.

The present invention may further comprise at least one dealer input device 17. The at least one dealer input device 17 is a button or similar physical input device that allows the dealer to manually perform actions such as dealing cards, folding player hands, and deactivating player stations. As such, the at least one dealer input device 17 may be a deal button, a fold button, or a player station activation/deactivation button. The at least one dealer input device 17 is positioned at the dealer station 11, allowing the dealer to easily access the at least one dealer input device 17 as needed. Each of the plurality of player stations 3 may further comprise a player input device 10 such as a button or similar physical input device. The player input device 10 is utilized by a player to perform actions such as opting into or out of a hand. Additionally, the player input device 10 may be utilized to fold a hand. The player input device 10 is positioned adjacent to the at least one flexible display 4 and as such is easily accessible by the player. The at least one dealer input device 17 and the player input device 10 are electronically connected to the gameplay control unit 16 as shown in FIG. 2 and as such, inputs from the dealer and the players are processed and executed by the gameplay control unit 16. This greatly increases the pace of play and prevents the time that is wasted when performing the same actions with conventional playing cards.

Figure 8:
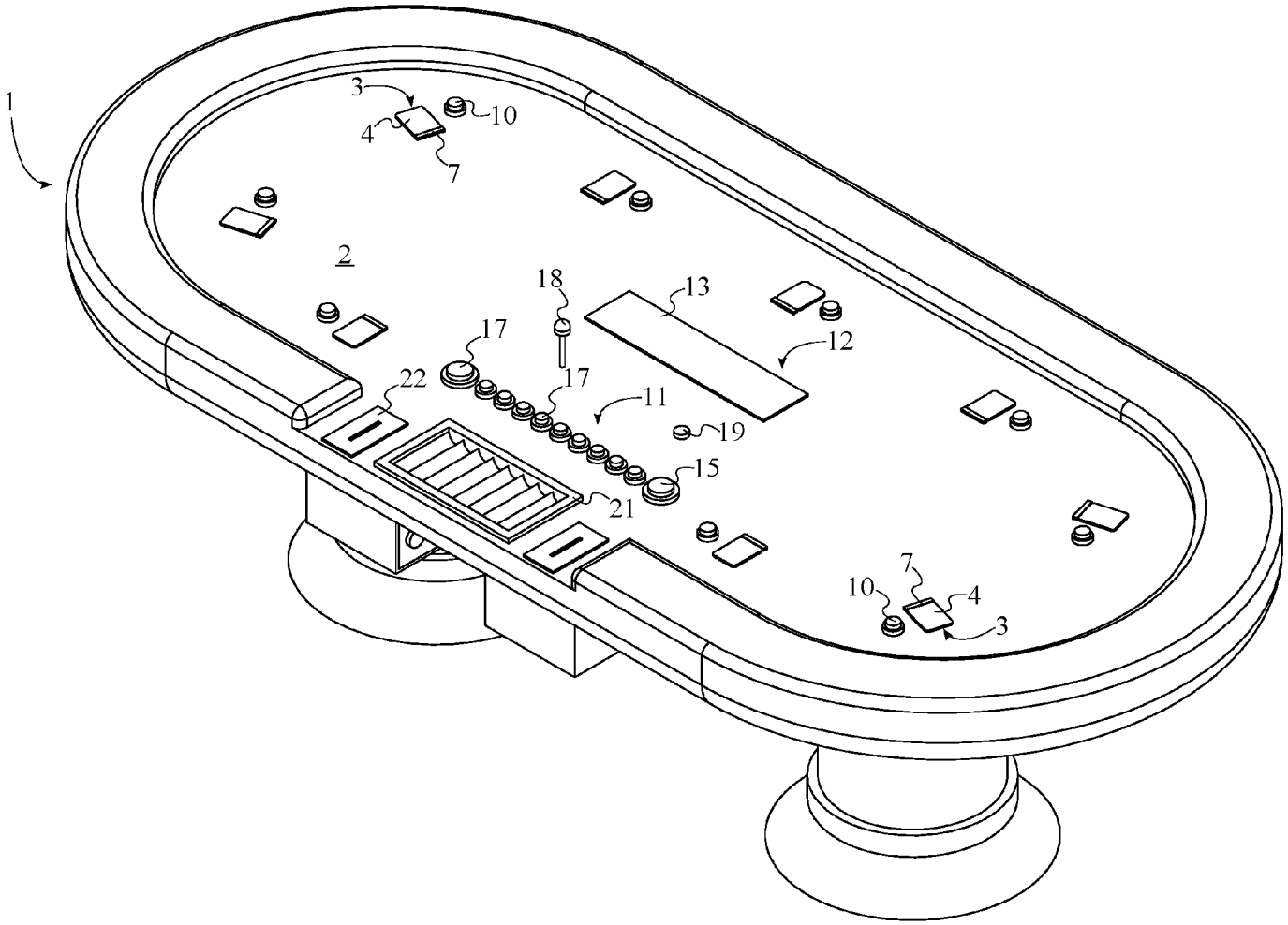
FIG. 8 is a perspective view of an embodiment of the present invention comprising at least one motion sensor and at least one audio sensor.
Figure 9:
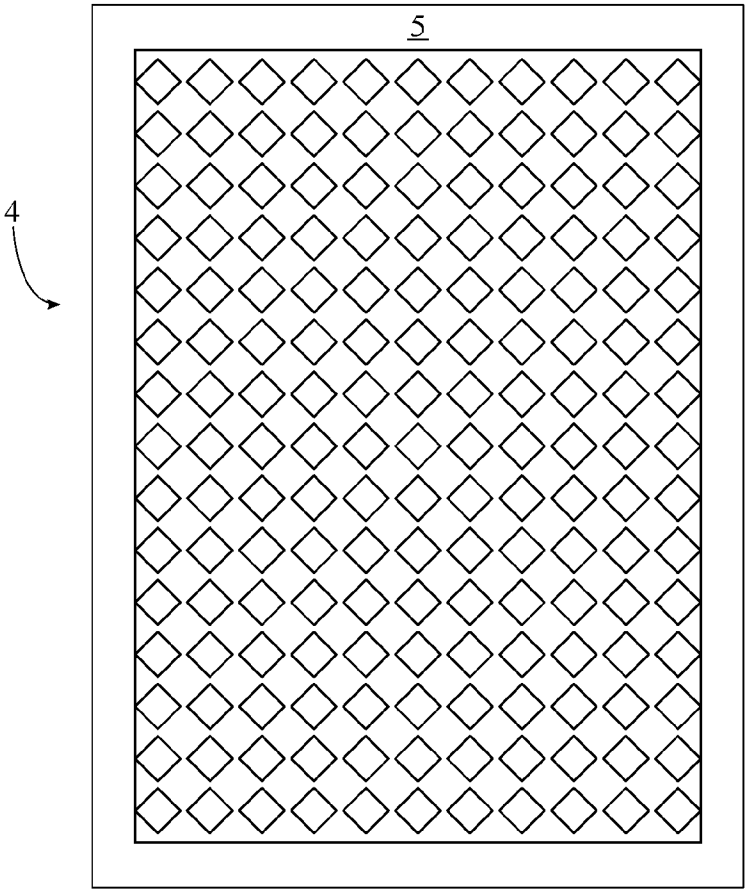
FIG. 9 is a bottom view of the at least one flexible display showing the backing surface with the backing surface displaying an electronic image of a playing card backing.

Various embodiments of the present invention may further comprise at least one motion sensor 18 and at least one audio sensor 19 as shown in FIG. 8. The at least one motion sensor 18 enables motion-based commands for the players and the dealer when performing various actions while the at least one audio sensor 19 enables similar voice-based commands for the players and the dealer. The at least one motion sensor 18 and the at least one audio sensor 19 are positioned on the table 1 in order to allow player and dealer motions and voice commands to be easily received by the at least one motion sensor 18 and the at least one audio sensor 19. The at least one motion sensor 18 and the at least one audio sensor 19 are electronically connected to the gameplay control unit 16. As such, received motion and voice-based commands are processed and executed by the gameplay control unit 16.

The present invention further comprises at least one dealer tray 21 and at least one secure drop box 22. The at least one dealer tray 21 stores dealer equipment as well as extra chips for players to use when placing wagers during play. The at least one dealer tray 21 is seated into the playing surface 2 on the dealer station 11, allowing the dealer equipment and the extra chips to be secured within the at least one dealer tray 21 embedded into the playing surface 2. The at least one secure drop box 22 is utilized for storing rake/house money collected throughout the course of play. The at least one secure drop box 22 is seated into the playing surface 2, adjacent to the at least one dealer tray 21. The at least one secure drop box 22 may include a security means for preventing the unauthorized removal of the at least one secure drop box 22 from the table 1.

Various alternative embodiments of the present invention may include a means for tracking player statistics. Cumulative player statistics may include hours played, tables played, hands played, and similar information. Further alternative embodiments of the present invention may include a casino/house services system through which players are able to request services for food/drinks. The casino/house services system may be expanded to include features such as indicating an open station among the plurality of player stations 3, calling for a supervisor, or requesting more player chips. Additional alternative embodiments of the present invention may include integrated cameras or other technology for use in broadcasting games being played through the present invention on television, online, or a similar broadcasting medium.

In the embodiment of the present invention shown in FIG. 13, the present invention further comprises a plurality of player status indicator devices 20 that are utilized to display whether or not players are opted into or out of a hand. Each of the plurality of player status indicator devices 20 is positioned adjacent to a corresponding station from the plurality of player stations 3. The status of each player at the table 1 is thus clearly visible to all. The plurality of player status indicator devices 20 may be utilized in conjunction with or in lieu of the backing surface 5 when the backing surface 5 is utilized as a player status indicator as shown in FIG. 11.

Although the present invention has been explained in relation to its preferred embodiment, it is understood that many other possible modifications and variations can be made without departing from the spirit and scope of the present invention as hereinafter claimed.

What is claimed is:

1. An electronic poker system comprises:

a table;

a plurality of player stations;

a dealer station;

at least one game display;

a dealer action undo input device;

a gameplay control unit;

the table comprises a playing surface;

each of the plurality of player stations comprises at least one flexible display;

each of the at least one flexible display comprises a backing surface and a front surface;

the plurality of player stations being distributed about the table;

the dealer station being positioned on the table, among the plurality of player stations;

each of the at least one flexible display being mounted to the playing surface;

the at least one game display being positioned on the playing surface;

the dealer action undo input device being positioned at the dealer station, such that the dealer action undo input device is accessible by a dealer;

the gameplay control unit being electronically connected to the dealer action undo input device, the at least one game display, and each of the at least one flexible displays, wherein the gameplay control unit is configured to process incorrect dealer actions inputted through the dealer action undo input device, such that the dealer action undo input device is configured to enable the dealer to undo the incorrect dealer actions;

the backing surface being layered adjacent to the front surface;

each of the at least one flexible displays further comprises a tether device;

each of the at least one flexible displays being mounted to the playing surface through the tether device;

the tether device comprises a track and a platform;

the track being positioned on the playing surface;

the platform being slidably engaged into the track; and the at least one flexible display being positioned on the platform and moving along the track.

2. The electronic poker system as claimed in claim 1 further comprises:

each of the at least one flexible displays being removably mounted to the playing surface through the platform.

3. The electronic poker system as claimed in claim 1 further comprises:

each of the at least one flexible displays being non-removably mounted to the playing surface through the platform.

4. The electronic poker system as claimed in claim 1 further comprises:

the platform being removably engaged into the track.

5. The electronic poker system as claimed in claim 1 further comprises:

the platform being non-removably engaged into the track.

6. The electronic poker system as claimed in claim 1, wherein the backing surface displays an electronic image of a playing card backing.

7. The electronic poker system as claimed in claim 1, wherein the backing surface displays a player status indicator.

8. The electronic poker system as claimed in claim 1, wherein the backing surface displays an electronic image of a logo.

9. The electronic poker system as claimed in claim 1, wherein the front surface displays an electronic image of a playing card.

10. The electronic poker system as claimed in claim 1, wherein the plurality of player stations is arranged perimetrically about the table.

11. The electronic poker system as claimed in claim 1 further comprises:

the at least one game display comprises a community card display; and the community card display being positioned centrally on the playing surface.

12. The electronic poker system as claimed in claim 1 further comprises:

the at least one game display comprises a plurality of community card displays;

the plurality of community card displays being positioned centrally on the playing surface; and the plurality of community card displays being positioned adjacent to each other, wherein the plurality of community cards is arranged in a single row.

13. The electronic poker system as claimed in claim 1, wherein the backing surface and the front surface are flexible organic light-emitting diode (FOLED) touch displays.

14. The electronic poker system as claimed in claim 1 further comprises:

at least one dealer input device;

each of the plurality of player stations further comprises a player input device;

the at least one dealer input device being positioned at the dealer station;

the player input device being positioned adjacent to the at least one flexible display; and the at least one dealer input device and the player input device being electronically connected to the gameplay control unit.

15. The electronic poker system as claimed in claim 14, wherein the at least one dealer input device is a deal button.

16. The electronic poker system as claimed in claim 14, wherein the at least one dealer input device is a player station activation button.

17. The electronic poker system as claimed in claim 1 further comprises:

at least one motion sensor;

at least one audio sensor;

the at least one motion sensor and the at least one audio sensor being positioned on the table; and the at least one motion sensor and the at least one audio sensor being electronically connected to the gameplay control unit.

18. The electronic poker system as claimed in claim 1 further comprises:

at least one dealer tray;

at least one secure drop box;

the at least one dealer tray being seated into the playing surface on the dealer station; and the at least one secure drop box being seated into the playing surface, adjacent to the at least one dealer tray.

19. The electronic poker system as claimed in claim 1 further comprises:

a plurality of player status indicator devices; and each of the plurality of player status indicator devices being positioned adjacent to a corresponding station from the plurality of player stations.

* * * * *